US007410032B2

(12) United States Patent
Kolb et al.

(10) Patent No.: US 7,410,032 B2
(45) Date of Patent: Aug. 12, 2008

(54) PULLEY ARRANGEMENT FOR ELEVATORS

(75) Inventors: Emmanuel Kolb, Reiningue (FR); Denis Sittler, Illzach (FR)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/298,346

(22) Filed: Dec. 9, 2005

(65) Prior Publication Data

US 2006/0175140 A1 Aug. 10, 2006

(30) Foreign Application Priority Data

Dec. 10, 2004 (EP) ..... 04106489

(51) Int. Cl.
*B66B 11/08* (2006.01)
*B66B 11/04* (2006.01)
*B66B 11/02* (2006.01)

(52) U.S. Cl. ..... 187/266; 187/252; 187/401

(58) Field of Classification Search ..... 187/252, 187/266, 401
See application file for complete search history.

(56) References Cited

U.S. PATENT DOCUMENTS 3,101,130 A * 8/1963 Bianca ..... 187/244
4,977,980 A * 12/1990 Hifumi ..... 187/253
5,490,577 A * 2/1996 Yoo ..... 187/252
5,533,595 A * 7/1996 Narumi et al. ..... 187/266
6,443,266 B2 * 9/2002 Murakami et al. ..... 187/401
6,640,935 B1 * 11/2003 Murakami et al. ..... 187/401
6,715,587 B2 * 4/2004 Sittler et al. ..... 187/401
6,722,475 B2 * 4/2004 Miller et al. ..... 187/266

FOREIGN PATENT DOCUMENTS

| | | |
|---|---|---|
| EP | 0 983 957 A2 | 3/2000 |
| EP | 1364905 | 11/2003 |
| EP | 1457454 | 9/2004 |
| JP | 10182035 | 7/1998 |
| WO | WO 2005047159 | 5/2005 |

* cited by examiner

*Primary Examiner*—Peter M. Cuomo
*Assistant Examiner*—Eric Pico
(74) *Attorney, Agent, or Firm*—Buchanan, Ingersoll & Rooney

(57) ABSTRACT

An elevator cage made up of a car, a support member connected to the car, and a pulley box housing a pair of pulleys mounted to the pulley box by pulley axles. The pulley box is mounted to the support member through one or more points located below a first line P bisecting the pulley axles and above a second line Q defining a lowest common tangent between the pulleys.

9 Claims, 5 Drawing Sheets

PULLEY ARRANGEMENT FOR ELEVATORS

BACKGROUND OF THE INVENTION

The invention relates to elevators and, in particular, to elevators wherein the elevator cage is mounted on one or more ropes or belts by means of a pulley arrangement.

Pulley arrangements are commonly used in the elevator industry to mount and drive an elevator cage along ropes arranged within a hoistway in a building. In such an arrangement a pulley box containing two pulleys is mounted on the cage so that as the rope is driven, whether by hydraulic ram or traction sheave, it travels down along one side of the hoistway, engages with one of the pulleys deflecting it through 90°, traverses across the car, engages with the other pulley which deflects it back into the vertical plane, and travels upwards along the opposite side of the hoistway. The pulley box can be mounted to the cage at a point above the passenger car or it can be mounted below the passenger car in which case it is called and underslung arrangement. Such an arrangement is illustrated and described in U.S. Pat. No. 6,443,266.

According to ASME Code A17.1-2000, the ratio of the diameter of the pulleys to the nominal diameter of the suspension ropes should be at least 40. Hence, the diameter of each pulley is significantly larger than its width and consequently the height of the pulley box is greater that its width.

In the prior art as exemplified in FIG. 1, an upper surface 18 of the pulley box 8 is mounted to the cage either directly to a base of the passenger car or, if the car is contained within a frame, to a lower yoke of the car frame. However, in use, the majority of the vertical forces F are transferred through the lowermost portions A of the pulleys 9. Accordingly, if the pulley box 8 tilts by an angle $\alpha$, a relatively large bending moment is exerted about the mounting point of the pulley box. The magnitude of the bending moment is defined by the equation $M=Fx$, where F is the vertical force and x is the horizontal distance between the mounting point on the upper surface 18 of the pulley box 8 and the point of application of the vertical force. F. Furthermore, the value x can be expressed as $x=L \cos \alpha$ where L is the distance between the mounting point on the upper surface 18 and the lowermost portions A of the pulleys 9. Accordingly, for a given vertical force F and a given tilt angle $\alpha$, the bending moment M is directly proportional to the value L. However, since the dimension L is principally dependent on the diameter of the pulley 9 which in turn is determined by regulatory bodies as discussed in the preceding paragraph, there is very little scope for reducing the bending moment M.

Hence, both the pulley box 8 itself and the conventional means for mounting the pulley box 8 to the cage must be capable of withstanding substantial bending moments, otherwise as the cage and the pulley box tilt, the unrestrained bending moment and the tilt angle of the pulley box would progressively increase until eventually the pulley box is permanently deformed or torn from its mounting.

This phenomenon is further exaggerated when the suspension rope is replaced by a belt as any torsion in the belt may be transferred to the pulley box to establish a bending moment about the mounting point even without any tipping of the pulley box.

SUMMARY OF THE INVENTION

Accordingly, the objective of the present invention is to reduce the bending moments about the point at which the pulley box is mounted to the cage. This objective is achieved by providing an elevator cage comprising a car, a support member connected to the car, and a pulley box housing a pair of pulleys mounted to the pulley box by pulley axles. The pulley box is mounted to the support member through one or more points located below a first line bisecting the pulley axles and above a second line defining a lowest common tangent between the pulleys. In comparison to the prior art, the mounting points of the invention are located closer to the lowermost portions of the pulleys through which the majority of the vertical forces are transferred and hence the bending moments about the mounting points are significantly reduced.

Preferably, the pulley box is mounted on one or more mounting bars extending from the support member. This arrangement greatly simplifies the assembly of the elevator cage on site and makes horizontal adjustment of the pulley box much easier since the mounting bars are relatively accessible after installation in comparison to the bolts used in the prior art to mount an upper surface of the pulley box to a car floor or to the yoke. Furthermore, the transmission of any vibration from the pulley box to the car can be significantly reduced by providing resilient material between the pulley box and each mounting bar.

The invention permits an arrangement wherein the support member is a yoke which is fixed directly to a floor of the car. If this configuration is used, it is beneficial to provide a closing plate which is secured to the floor of the car and engages with each mounting bar at an end remote from the yoke such that the pulley box is disposed between the closing plate and the yoke. Accordingly, vertical forces are transmitted not only through the yoke but also through the closing plate. As the force transmitted through the yoke is reduced, it can have a light weight structure in comparison to the prior art. Preferably, the yoke and the closing plate are both formed from sheet metal.

Other features and advantages of the present invention will become apparent from the following description of the invention that refers to the accompanying drawings.

BRIEF DESCRIPTION OF THE DRAWINGS

The present invention is herein described by way of specific examples with reference to the accompanying drawings of which.

DETAILED DESCRIPTION OF THE INVENTION

Figure 1:
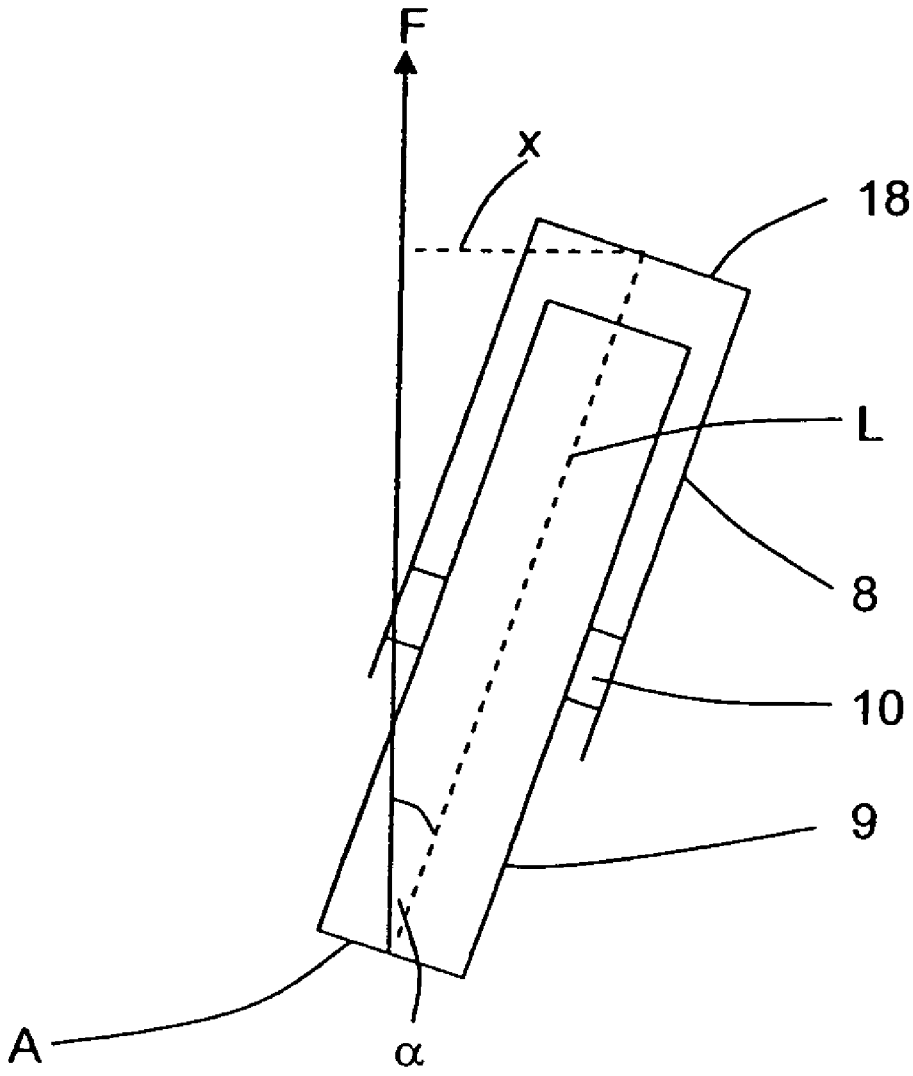
FIG. 1 Prior Art
FIG. 1 is a simplified diagram illustrating the forces exerted on a prior art pulley box.

Throughout the following, features that are common to more than one of the embodiments have given the same reference numerals so as to avoid unnecessary repetition thereof in the description of the invention.

Figure 2:
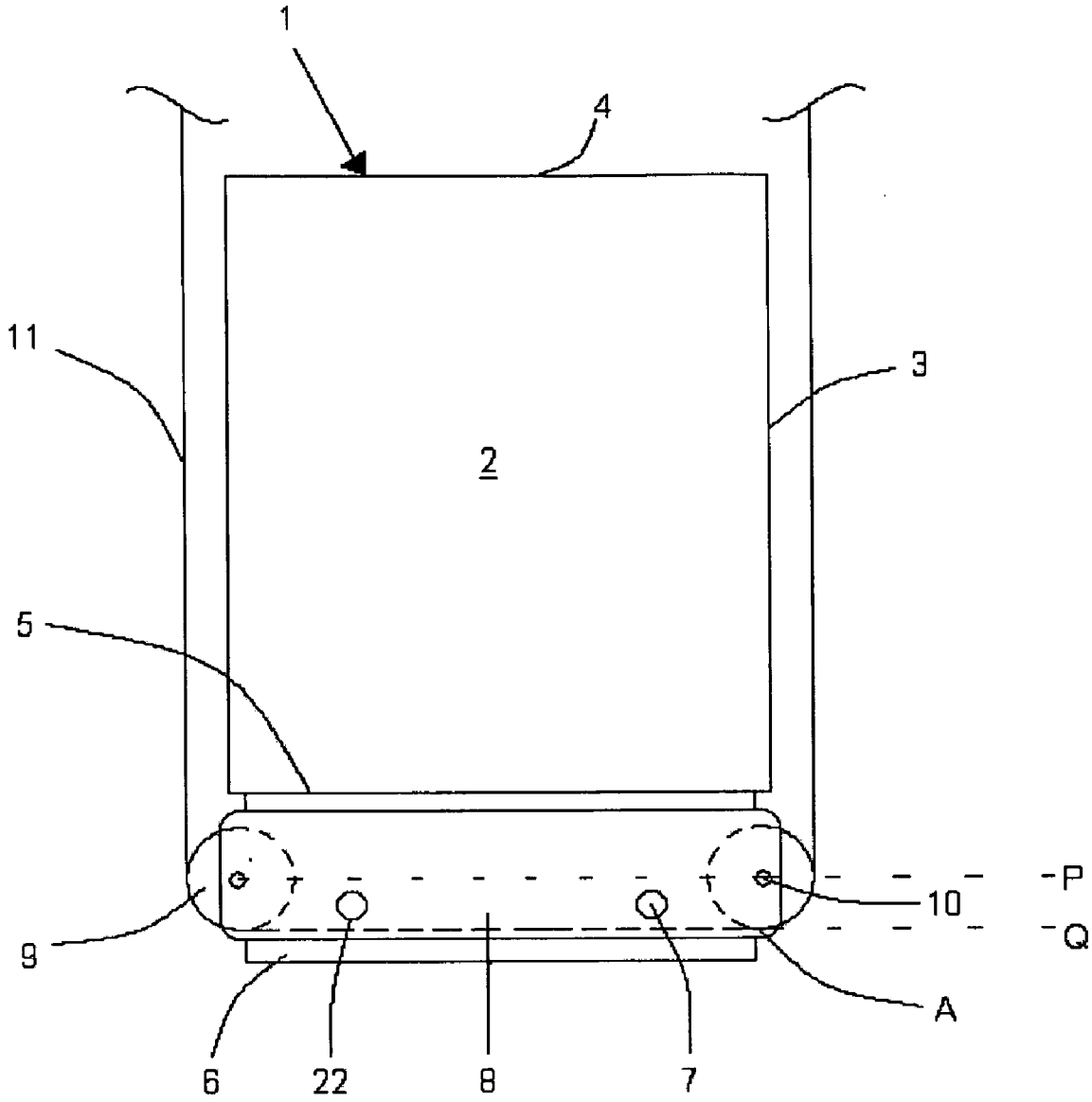
FIG. 2 is a general schematic front view of an elevator incorporating an elevator cage according to the present invention.

FIG. 2 shows an elevator cage 1 supported by a pulley box 8 on ropes 11 within an elevator hoistway (not shown). The cage 1 comprises a conventional car 2 having a plurality of side walls 3, a roof 4 and a floor 5 defining a transport space for passengers and/or goods. A support yoke 6 is mounted directly beneath the floor 5 of the car 2. The yoke 6 has two parallel mounting bars 7 extending horizontally outwards into corresponding holes 22 in the pulley box 8. A diverting pulley 9 is mounted on a pulley axle 10 at either box 8 to engage with the suspension ropes 11.

The mounting bars 7 and the corresponding holes 22 are located between a first line P bisecting the pulley axles 10 and a second line Q defining a lowest common tangent between the pulleys 9. In the present embodiment, the lowest common tangent Q corresponds to a line between the lowermost sections A of the pulleys 9.

As the ropes 11 are driven, they travel down along one side of the car 2, engage with one of the pulleys 9 deflecting them through 90°, traverse underneath the car 2, engage with the other pulley 9 which deflects them back into the vertical plane, and travel upwards along the opposite side of the car 2.

Figure 3:
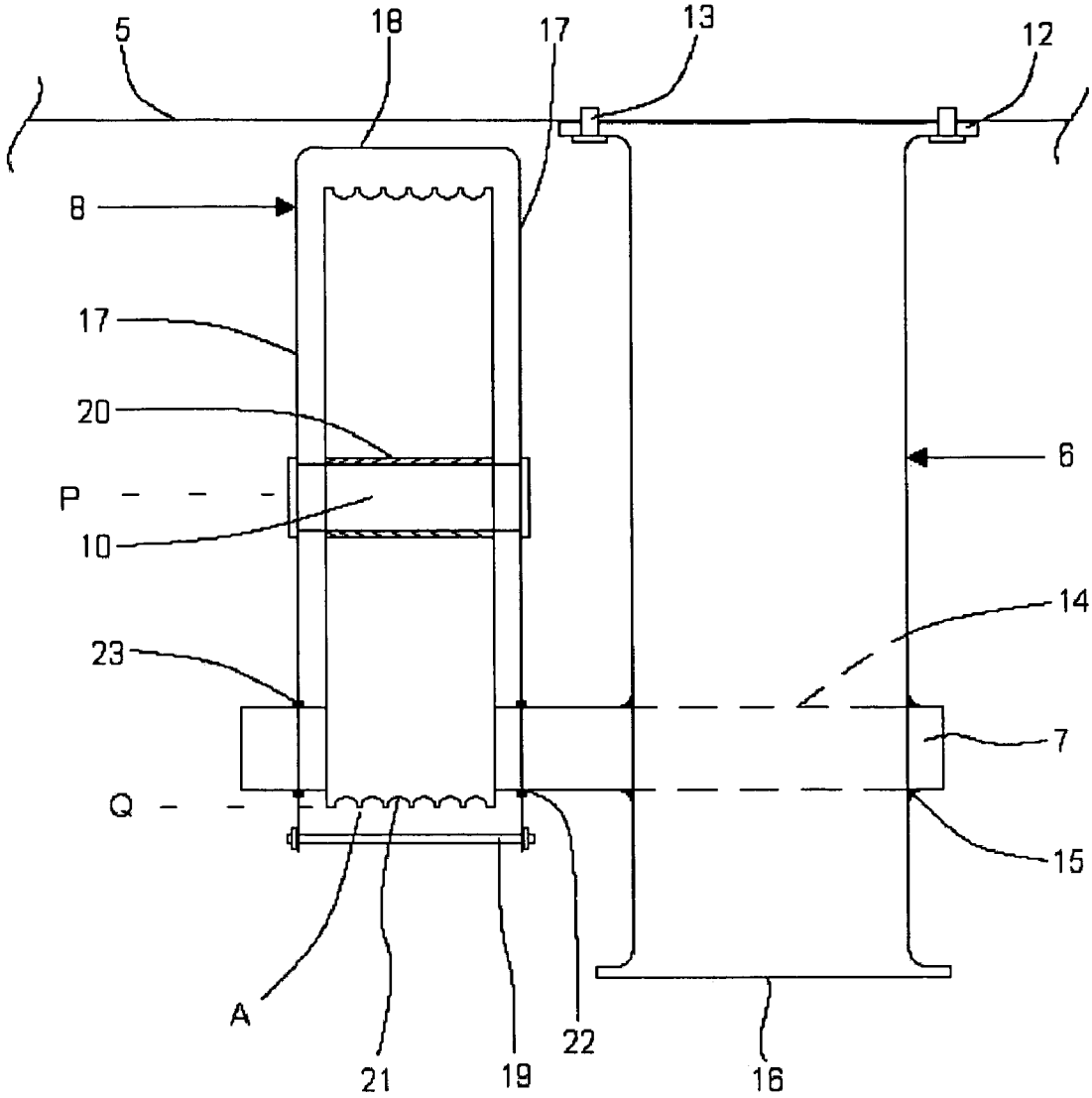
FIG. 3 is a partial side view of the underslung pulley arrangement of FIG. 2.

FIG. 3 is a partial side view of arrangement of FIG. 2 which further illustrates the yoke 6 and the pulley box 8. As shown, the yoke 6 is a solid I-beam with upper flanges 12 that are firmly secured to the bottom of the car floor 5 by a series of bolts or rivets 13. Each mounting bar 7 is inserted into a through-hole 14 in the I-beam 6 and secured in position at weld points 15. Further elevator components (not shown) such as guide shoes or safety gear can be mounted to a bottom surface 16 of the yoke 6.

The pulley box 8 is of an inverted U-shape construction having opposing side sections 17 interconnected by an intermediate section 18. Preferably the pulley box 8 is fabricated from sheet metal. Bolts 19 are used to fasten the free edges of the opposing side sections 17 together and thereby improve the overall structural rigidity of the pulley box 8. Each diverting pulley 9 is rotatably mounted on a pulley axle 10 via, a bearing 20. The pulley axles 10 are secured to the opposing side sections 17 of the pulley box 8 in any conventional manner. Outer circumferential grooves 21 are provided on the diverting pulley 9 to engage and retain the suspension ropes 11.

The mounting bars 7 are inserted through the mounting holes 22 in the opposing side sections 17 of the pulley box 8. In use, as the pulleys 9 rotate due to their interaction with the ropes 11, vibrations can be generated in the pulley box 8. A resilient ring insert 23 is provided between each of the mounting holes 22 and the respective mounting bars 7 to absorb this vibration.

Figure 4:
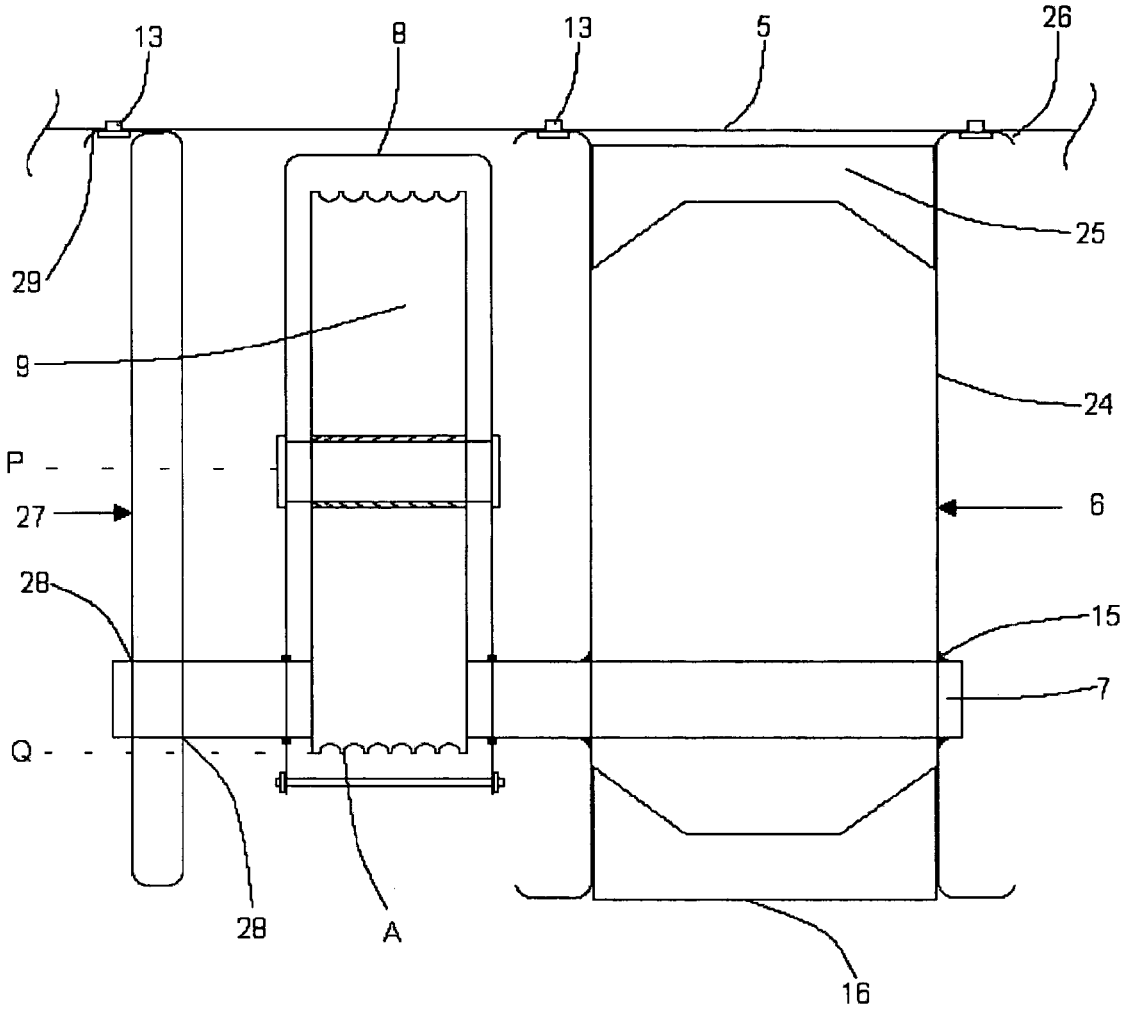
FIG. 4 is a partial side view of an underslung pulley arrangement according to a second embodiment of the present invention.

FIG. 4 shows an alternative embodiment of the invention wherein the relatively heavy I-beam used as the support yoke 6 in the previous embodiment is replace by a light weight structure. The yoke 6 in this instance comprises a pair of vertically aligned sheet metal plates 24 interconnected by rigid web members 25. As in the previous embodiment, upper flanges 26 on the sheet metal plates 24 are firmly secured to the bottom of the car floor 5 by a series of bolts or rivets 13 and the mounting bars 7 are secured in position at weld points 15. Furthermore, a closing plate 27 is provided at opposing ends of the mounting bars 7 such that the pulley box 8 is positioned intermediate the yoke 6 and the closing plate 27. The closing plate 27 is formed from a sheet metal plate which is bent over to give a double wall structure. An upper flange 29 of the closing plate 27 is secured to the car floor 5 by a series of bolts or rivets 13 and holes 28 are punches through the closing plate 27 to accommodate the mounting bars 7. The closing plate 27 is not fixed to the mounting bars 7 and therefore it cannot transmit any horizontal forces between the pulley box 8 and the car 2. However, any vertical forces between the pulley box 8 and the car 2 are shared between the closing plate 27 and the support yoke 6.

Figure 5:
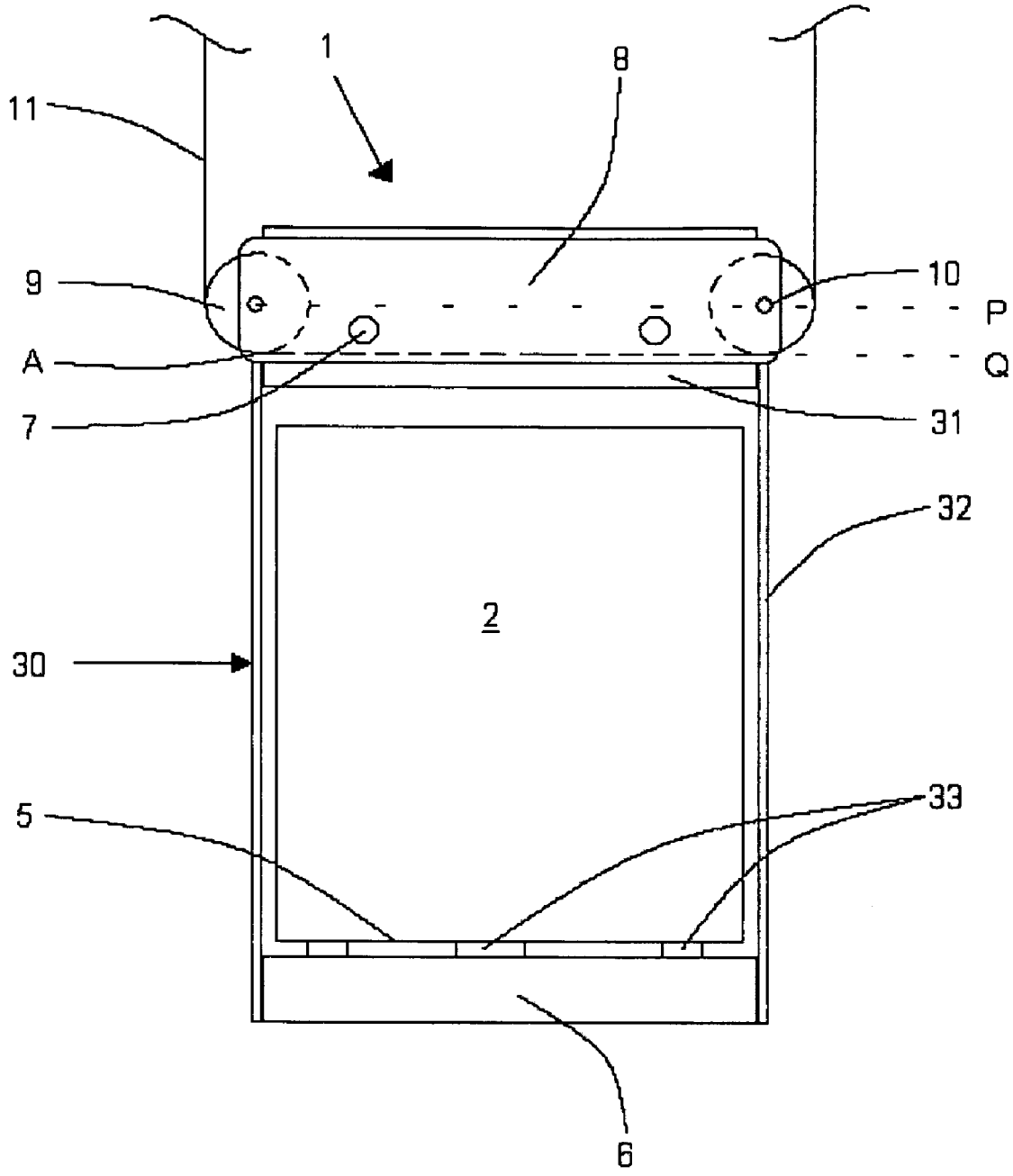
FIG. 5 is a general schematic front view of an elevator incorporating an elevator cage according to a further embodiment of the present invention.

An alternative to the previously described underslung arrangements is shown in FIG. 5. In this embodiment the car 2 is supported through anti-vibrational pads 33 to a frame 30. The frame 30 comprises an upper crosshead 31, a lower yoke 6 and a pair of uprights 32. The pulley box 8 in this instance is supported on mounting bars 7 extending from the crosshead 31.

It will be appreciated by a person skilled in the art, that the pulley box 8 and the pulleys 9 can easily be modified to engage with a belt or belts instead of the ropes 11 previously described.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. An elevator cage, comprising: a car; a support member connected to the car; and a pulley box housing a pair of pulleys mounted to the pulley box by pulley axles, the pulley box being mounted to the support member at at least one point located below a first line bisecting the pulley axles and above a second line defining a lowest common tangent between the pulleys.

2. The elevator cage according to claim 1, and further comprising at least one mounting bar extending from the support member, the pulley box being mounted on the mounting bar.

3. The elevator cage according to claim 2, and further comprising resilient material arranged between the pulley box and the mounting bar.

4. The elevator cage according to claim 2, wherein the support member is a yoke secured to a floor of the car.

5. The elevator cage according to claim 4, and further comprising a closing plate secured to the floor of the car and engaged with an end of the mounting bar remote from the yoke.

6. The elevator cage according to claim 5, wherein at least one of the yoke and the closing plate are formed from sheet metal.

7. The elevator cage according to claim 1, wherein the support member forms a part of a frame in which the car is suspended.

8. The elevator cage according to claim 7, wherein the support member is a lower yoke of the frame.

9. The elevator cage according to claim 7, wherein the support member is an upper crosshead of the frame.

* * * * *